US006397862B1

(12) United States Patent
DeSenna et al.

(10) Patent No.: US 6,397,862 B1
(45) Date of Patent: Jun. 4, 2002

(54) METHOD OF CLEANING GARBAGE DISPOSALS

(76) Inventors: Richard A. DeSenna, 11500 Donnington Dr., Duluth, GA (US) 30097; Hilton G. Dawson, 110 Waterford Falls Dr., Canton, GA (US) 30114; Ryan Giffin Moore, 5070 Arcado Rd., Lilburn, GA (US) 30047

( * ) Notice: Subject to any disclaimer, the term of this patent is extended or adjusted under 35 U.S.C. 154(b) by 0 days.

(21) Appl. No.: 09/948,358

(22) Filed: Sep. 7, 2001

Related U.S. Application Data

(62) Division of application No. 09/625,258, filed on Jul. 25, 2000, now abandoned.
(60) Provisional application No. 60/194,152, filed on Apr. 3, 2000.

(51) Int. Cl.[7] ..... B08B 9/02; B08B 9/027
(52) U.S. Cl. ..... 134/22.1; 134/22.13; 134/22.14; 134/22.16; 134/22.17; 134/22.19; 134/23; 510/194
(58) Field of Search ..... 134/22.1, 22.13, 134/22.14, 22.16, 22.17, 22.19, 23; 510/194

(56) References Cited

U.S. PATENT DOCUMENTS 3,236,726 A * 2/1966 Ross ..... 167/17
3,775,334 A * 11/1973 Christie ..... 510/194
4,104,190 A * 8/1978 Hartshorn ..... 252/187 R
4,265,847 A * 5/1981 Hunt et al. ..... 264/122
4,619,710 A * 10/1986 Kuenn et al. ..... 134/22.17
4,664,836 A * 5/1987 Taylor, Jr. et al. ..... 510/195
5,630,883 A * 5/1997 Steer et al. ..... 134/22.13
5,741,520 A * 4/1998 DeSenna ..... 424/466
5,817,337 A * 10/1998 DeSenna ..... 424/466
5,931,172 A * 8/1999 Steer et al. ..... 134/22.13
6,099,861 A * 8/2000 DeSenna ..... 424/466
6,136,768 A * 10/2000 Dawson et al. ..... 510/195
6,165,505 A * 12/2000 DeSenna et al. ..... 424/466

FOREIGN PATENT DOCUMENTS

CH 1081562 A * 2/1994
GB 1165098 * 9/1969
GB 1427710 * 3/1976
GB 2242130 A * 9/1991

* cited by examiner

*Primary Examiner*—Lorna M. Douyon
(74) *Attorney, Agent, or Firm*—James W. Kayden; Thomas, Kayden, Horstemeyer & Risley

(57) ABSTRACT

A method for cleaning garbage disposals comprises the steps of: mixing the starting materials in order to form an effervescent tablet; packaging the tablet in a moisture resistant pouch; placing the tablet in a garbage disposal unit; running warm water into the garbage disposal unit and turning on the garbage disposal for about 20 seconds; turning off the water and the garbage disposal, permitting the foam generated to maintain contact with all surfaces for about five minutes; and followed by rinsing away any left-over residue with generous amounts of water.

31 Claims, No Drawings

METHOD OF CLEANING GARBAGE DISPOSALS

CROSS-REFERENCE TO RELATED APPLICATION

This application claims priority to copending U.S. provisional application entitled, "FOAMING GARBAGE DISPOSAL SANITIZER TABLET & METHOD OF CLEANING GARBAGE DISPOSALS" having Ser. No. 60/194,152, filed Apr. 3, 2000, which is entirely incorporated herein by reference. This application is a divisional of copending U.S. utility application entitled, "Foaming Garbage Disposal Sanitizer Tablet and Method of Cleaning Garbage Disposals," having Ser. No. 09/625,258, filed Jul. 25, 2000, now abandoned which is entirely incorporated herein by reference.

TECHNICAL FIELD

The present invention is generally related to a garbage disposal sanitizer and, more particularly, is related to a method for preparing garbage disposal sanitizers in an effervescent tablet formulation.

BACKGROUND OF THE INVENTION

All garbage disposals found in private residences and public facilities are contaminated by various organic materials that contain or support the growth of various pathogens and odor-causing organisms. Cleaning and normal rinsing alone is not sufficient to kill or inhibit the growth of these organisms and use of disinfectants is necessary.

A disinfectant is a substance that destroys or irreversibly inactivates infectious or other undesirable bacteria, pathogenic fungi, and viruses or surfaces or inanimate objects. Disinfectants kill the growing forms but not necessarily the resistant spore forms of microorganisms. Sterilizers, on the other hand, destroy the growing and spore forms of viruses, bacteria, and fungi on inanimate surfaces. Sanitizers are used to reduce the number of living bacteria or viable virus particles on inanimate surfaces, in water, or in air, and fungicides and fungistats are used to inhibit the growth of or destroy fungi on inanimate surfaces.

It has become common practice to use glutaraldehyde solutions as surface disinfectants or sterilants. However, while glutaraldehyde solutions are an effective disinfectant, there are many drawbacks to the use of glutaraldehyde, including safety concerns, problems with storing the large volumes of solutions required, and the limited shelf stability of solutions. In addition, if the glutaraldehyde solution is prepared by dilution of a concentrated solution there is the inconvenience of measuring and pouring the liquid concentrate.

The use of disinfectant or sterilant concentrates in a powdered form has been taught in the prior art; for example, in U.S Pat. No. 5,350,563 to Kralovic et al. The problem with the use of powders as disinfectant concentrates is that they also must be measured in order to prepare the diluted solution and must be poured from one container to another. In addition, there are sometimes problems with forcing the powder into solution.

Concentrated liquid cleaners have been found to be highly desirable by certain consumers. Important considerations in the selection of a cleaning composition include ease of handling, cleaning ability and stability of the product during storage.

One advantage of liquid cleaners is the ease of handling because liquids can be automatically pumped or dispensed directly to their final use application. Liquid cleaners can also be made into a highly concentrated intermediate aqueous solution which is subsequently flushed/diluted to its proper final use application solution. Liquid cleaners are generally more rapidly soluble than powder or granule cleaners with the same or comparable active ingredients. Liquid cleaners can use higher levels of some surfactants that would cause powders or granules to cake if used at similar levels.

Almost all liquid cleaners have the disadvantage that they are diluted with water, so larger volumes and weights have to be shipped, stored, and used to accomplish cleaning equivalent to a highly concentrated powder or granules. Also, liquid cleaners cannot tolerate high concentrations of organic surfactants with dissolved inorganic builders and sequestering agents with all the ingredients remaining homogenous throughout their shipping and storage. Many liquid cleaners utilize high concentrations of corrosive chemicals which easily spill or splatter on users causing chemical burns, inhalation bums, blindness or discomfort. Liquids can be corrosive to their dispensing equipment by virtue of the caustic alkali being incompatible with pump parts or delivery tubing. Additionally, the ingredients within liquids interact because the ingredient molecules are mobile. These interactions can precipitate or irreversibly inactivate some of the active ingredients upon storage. Furthermore, liquids, for the most part, do not allow a stable, homogeneous solution of surfactants, builders, sequestrants and oxygen bleach sources in a compatible stable product with long term storage stability.

One advantage of powder and granular cleaners is the high concentrations of active ingredients because few or no inert ingredients are required. In powder or granule cleaners, high levels of inorganic or organic salts can be used to raise alkalinity and soften water by chelating or sequestering water hardness ions. The powdered or granule cleaners can be used to provide oxidizing agents (bleaches) or reducing agents and granular enzyme materials that can be blended into free flowing powder or granule cleaners. The oxidizing or reducing agents and the enzymes are stable in the powdered or granulated cleaners with no significant loss of activity on extended storage. However, oxidizing agents mixed with caustic agents can prematurely decompose. This occurs because some caustic agents, specifically alkali metal hydroxides, are hygroscopic and the highly alkaline solution formed on the surface of the caustic agents reacts with the oxidizing agents.

A significant disadvantage of powder or granular cleaners for commercial applications is that they are not as accurately controllable in dispensing equipment as liquids. Powder or granular systems can require manually scooping a quantity of powder or granules for each use, thus not taking advantage of the ease, accuracy and hands-off labor savings of liquid dispensers. Also, powders and granules can cake if exposed to high humidity or temperatures. Once they become caked, they cannot be subsequently removed from their shipping container. Powders and granules can lose some of their activity if moistened or exposed to high humidity. Non-homogeneous powders and granules can segregate in their shipping containers, that is, separate or stratify by particle size or density resulting in a non-uniform mixture that may not be appropriate for ultimate use applications. Furthermore, powders and granules can create a safety hazard in that granules or airborne dust particles of irritating or corrosive materials can exit their container or otherwise come in direct contact with tissue, including lung tissue, causing bums or discomfort.

Other patents, for example, those of Hunt et al., U.S. Pat. No. 4,265,847 (the '847 patent), and White et al., U.S. Pat. No. 4,536,389, teach effervescent tablets useful for preparing solutions for sterilizing or disinfecting. Such compositions are rapid water soluble tablets typically comprising an active chemical compound, an alkali metal bicarbonate, e.g. sodium or potassium bicarbonate, and a solid aliphatic carboxylic acid such as citric acid, tartaric acid, adipic acid, or an acid salt thereof. In use, such tablets are dissolved in water whereupon the interaction of the bicarbonate and acid components results in the release of carbon dioxide, thus increasing the rate of solution of the other components and producing a solution in which the active (disinfecting) ingredient is homogenously dissolved. Methods for forming effervescent tablets are well known in the art. For example, see the '847 patent and U.S. Pat. No. 5,114,647 to Levesque et al., which disclosures are incorporated herein in their entireties, by reference.

Halogen compounds are effective as disinfecting agents but their use as such agents is limited due to difficulties in storage, mixing, and handling of concentrated halogens and instability of dilute forms. The use of sodium dichloroisocyanurate as a disinfecting agent is known in the prior art. For example, see U.S. Pat. No. 4,536,389, to White et al., and U.S. Pat. No. 5,114,642, to Levesque et al. Sodium dichloroisocyanurate hydrolyzes in water to produce hypochlorous acid (HOCl) and hypochlorite ($OCl^-$), which exist in solution at an equilibrium that is dependent upon the pH of the solution. For example, as shown in FIG. 1, at neutral pH a solution consists of about 75% hypochlorous acid and 25% hypochlorite. The prior art also teaches the use of bromide as a disinfectant, the hypobromous acid and hypobromite species being produced in solution typically by the use of bromo, chloro-5,5-dimethylhydantoin. The hypohalous acid species is the antimicrobial form of the above compounds, with the hypohalite having some antimicrobial effect. However, the negative charge of the hypohalite inhibits its diffusion through the cell wall of microorganisms and thus lowers its antimicrobial effect.

U.S. Pat. No. 4,619,710 to Kuenn et al. (the '710 Patent), teaches a disposal cleaner containing a surfactant, an alkali carbonate and an acid. The preferred form of the composition of the '710 patent contains 37.5% adipic acid, 37.5% sodium bicarbonate and 25% of a mixture of sodium lauryl sulfate and alfa-olefin sulfonate. The '710 patent is preferably a powder packed in a moisture-resistant foil laminate pouch which consists of a paper laminated to plastic or synthetic materials. Preferably the dry powder composition would be packaged into a water soluble, biodegradable disposable film, which in turn would be wrapped with a foil pouch to prevent moisture damage. The problems associated with using a powder form of a cleaner discussed previously render the '710 patent inconvenient to use.

Accordingly, there is a need for an effective sanitizing agent for cleaning garbage disposals that is packaged and supplied in a convenient effervescent tablet form. The effervescent tablet must generate hypohalous acid and must fully and rapidly dissolve to form a homogeneous disinfecting solution which is highly active and stable for a useful length of time, as well as produce a sizeable amount of effervescent foam in the garbage disposal. It has been heretofore unknown in art how to produce an effective garbage disposal sanitizer in tablet form that requires running the disposal for only one to two seconds to activate and disperse the sanitizer.

Thus, a heretofore unaddressed need exists in the industry to address the aforementioned deficiencies and inadequacies.

SUMMARY OF THE INVENTION

The present invention is an effervescent tablet composition for use in sanitizing garbage disposals which includes a hypochlorite generator and an effervescent system. Further, the tablet composition may include surfactant, binder, fiber carrier, lubricant, and fragrance.

The present invention can also be used as a method for sanitizing garbage disposal units. In this regard, the method can be broadly summarized by the following steps: mixing starting materials, forming an effervescent tablet from the starting materials, packaging the tablet in a moisture-resistant pouch, placing the tablet in a garbage disposal unit, running warm tap water at a trickle, turning on the garbage disposal for about twenty seconds, turning off the tap water and the garbage disposal, thereby allowing the effervescent tablet to foam into the sink, allowing the foam to stand for about five minutes, thereby sanitizing the garbage disposal, and rinsing away any residue of the tablet with generous amounts of water.

DETAILED DESCRIPTION OF THE INVENTION

The present invention provides a non-liquid garbage disposal sanitizer in a tablet form and method of preparing the tablet. The garbage disposal sanitizer is contained in a single application atmospheric-resistant pouch. The single application pouches provide a convenient and compact, yet safe way to keep and store the garbage disposal sanitizer. To activate the garbage disposal sanitizer, the sanitizer is placed directly into the garbage disposal. Generally, single application pouches contain a pre-measured amount of cleaner to which is added approximately one liter of water or less to clean a garbage disposal. The effervescent foam fills the disposal and extends into the sink.

The garbage disposal sanitizer is carefully prepared, stored, and packaged to prevent moisture from initiating premature decomposition of the cleaning components, which would render it less effective. The garbage disposal sanitizer is produced in a moisture-controlled atmosphere. This is done to inhibit the active ingredients from absorbing moisture from the air. Thus, the preparation and packaging of the garbage disposal sanitizer decreases the possibility of premature decomposition.

The garbage disposal sanitizer includes at least one hypochlorite generator and an effervescent system. Additionally, at least one binder, lubricant, fiber carrier, fragrance, and surfactant can be included in the garbage disposal sanitizer.

The garbage disposal sanitizer includes a hypochlorite generator. The hypochlorite generator may include, but is not limited to, one or more of the following: chlorinated isocyanurates, e.g., dichloroisocyanurate (CDB); alkali metal hypochlorites, e.g., lithium hypochlorite; and alkaline earth metal hypochlorites, e.g., magnesium hypochlorite and calcium hypochlorite. More particularly, the hypochlorite generator used is an anhydrous form of dichloroisocyanurate. The hypochlorite generator represents 0.1–20% by weight of the total weight of the garbage disposal sanitizer. Surfactant represents typically 0.5%–15% by weight of the sanitizer. A surfactant that may be added is an ethoxylated alcohol such as Rhodosurf TB-970™, which falls within the above range.

In addition, the garbage disposal sanitizer includes an effervescent system. The effervescent system is composed of one or more of an alkali metal carbonate and an acid. One or more alkali metal carbonates may be selected from the following: sodium carbonate, sodium bicarbonate, potassium carbonate and potassium bicarbonate. More particularly, sodium bicarbonate is used as the alkali metal carbonate. Furthermore, one or more acids may be selected from the following: citric; maleic; fumaric; adipic; potassium or sodium phosphate, monobasic; oxalic; lactic; sulfamic; tartaric; sodium bisulfite; and sodium or potassium pyrophosphate. In a preferred embodiment, citric acid is used as the acid. The effervescent system, summation of the alkali metal carbonate and the acid, represents approximately 60–87% by weight of the total weight of the garbage disposal sanitizer.

Furthermore, the garbage disposal sanitizer may include lubricating agent, which, among other things limits sticking of the table to the punch faces of the tablet-forming press. The lubricant that may be used is selected from, but not limited to, the following: sodium benzoate, stearates, including magnesium stearate, mineral oil, silicates, or algenic acid. In a preferred embodiment, both sodium benzoate and magnesium stearate are used as the lubricating agents. The lubricant represents 0.5–8% by weight of the total weight of the garbage disposal sanitizer.

In addition, the garbage disposal sanitizer may include binder. The binder that may be used is selected from, but is not limited to, the following: polyethylene glycol, sorbitol, maltodextrin or sugars (e.g., lactose, sucrose). In a preferred embodiment, Carbowax 8000™ is used as the binder. The binder represents 1–5% by weight of the total weight of the garbage disposal sanitizer. In a preferred embodiment the binder is 3% by weight of the garbage disposal sanitizer.

Additionally, fiber carrier, e.g., cellulose, may be used in the present invention. The fiber carrier can be used to enhance the level of foam in certain formulations.

Table 1 below lists the ingredients of the preferred embodiment of the invention, as well as the weight percent of each ingredient.

TABLE 1

Ingredients of the Preferred Embodiment

| Ingredient | Preferred Range of Weight Percent (%) | Possible range of Weight Percent (%) |
|---|---|---|
| Citric Acid (fine granular) | 28–32 | 20–35 |
| Sodium Bicarbonate | 48–52 | 40–52 |
| CDB 63 | .5–3 | 0.1–2.0 |
| Rhodosurf TB-970 ™ | 4–8 | 5–12 |
| Sodium Lauryl Sufate | 2–6 | 3–6 |
| Lemon Fragrance (pre-mix) | 0–2 | 0.5–1.5 |
| PEG 8000 (30 mesh) | 1–5 | 1–5 |
| Sodium Benzoate | 1–5 | 1–5 |
| Magnesium Stearate | .5–3 | 0.5–3 |

The present invention also relates to the method of cleaning the garbage disposal. The method first involves adding all of the ingredients in Table 1 and forming the garbage disposal sanitizer tablet, including packaging in a moisture-resistant pouch. The tablet is then placed by the consumer in the disposal unit and warm water is turned on at a trickle (about 500 ml to 1.5 liters per minute), followed by turning on the disposal unit. Both the water and disposal are run for about 20 seconds, or until the foam reaches the sink, extending out of the mouth of the disposal. The disposal and water are then turned off. The foam is then allowed to stand for approximately five minutes, which is the sanitizer stage. Finally, the residue is rinsed away with generous amounts of water.

It should be emphasized that the above-described embodiments of the present invention, particularly, any "preferred" embodiments, are merely possible examples of implementations, and merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

Therefore, having thus described the invention, at least the following is claimed:

1. A method of cleaning garbage disposals, comprising the steps of:

mixing starting materials, wherein the starting materials comprise
a hypochlorite generator, and
an effervescent system;

forming an effervescent tablet from the starting materials;

packaging the tablet in a moisture-resistant pouch;

placing the tablet in a garbage disposal unit;

running warm tap water at a trickle;

turning on the garbage disposal for about twenty seconds;

turning off the tap water and the garbage disposal, thereby allowing the effervescent tablet to foam into the sink;

allowing the foam to stand for about five minutes, thereby sanitizing the garbage disposal; and rinsing away any residue of the tablet with generous amounts of water.

2. The method of claim 1, wherein the hypochlorite generator comprises from approximately 0.1% to approximately 2% by weight of the starting materials.

3. The method of claim 1, wherein the hypochlorite generator is chosen from the group consisting of: chlorinated isocyanurates, alkali metal hypochlorites, and alkaline earth metal hypochlorites.

4. The method of claim 3, wherein the chlorinated isocyanurate comprises dichloroisocyanurate (CDB).

5. The method of claim 3, wherein the alkali metal hypochlorite comprises lithium hypochlorite.

6. The method of claim 3, wherein the alkaline earth metal hypochlorite comprises magnesium hypochlorite.

7. The method of claim 3, wherein the alkaline earth metal hypochlorite comprises calcium hypochlorite.

8. The method of claim 1, wherein the an effervescent system comprises approximately 79% by weight of the starting materials.

9. The method of claim 1, wherein the effervescent system comprises an alkali metal carbonate; and an acid.

10. The method of claim 9, wherein the alkali metal carbonate comprises from about 40% to about 52% by weight of the starting materials.

11. The method of claim 9, wherein the alkali metal carbonate comprises sodium carbonate.

12. The method of claim 9, wherein the alkali metal carbonate comprises sodium bicarbonate.

13. The method of claim 9, wherein the alkali metal carbonate comprises potassium carbonate.

14. The method of claim 9, wherein the alkali metal carbonate comprises potassium bicarbonate.

15. The method of claim 9, wherein the acid comprises from approximately 20% to approximately 35% by weight of the starting materials.

16. The method of claim 9, wherein the acid is chosen from the group consisting of citric; maleic; fumaric; adipic;

potassium phosphate; sodium phosphate, monobasic; oxalic; lactic; sulfamic, tartaric; sodium bisulfite; sodium pyrophosphate; and potassium pyrophosphate.

17. The method of claim 1, wherein the starting materials further comprises a surfactant;

a binder;

a fiber carrier;

a lubricant; and a fragrance.

18. The method of claim 17, wherein the surfactant comprises from approximately 5% to approximately 12% by weight of the starting materials.

19. The method of claim 17, wherein the surfactant is a mixture of ethoxylated alcohol and sodium lauryl sulfate.

20. The method of claim 17, wherein the binder comprises from approximately 1% to approximately 5% by weight of the starting materials.

21. The method of claim 17, wherein the binder is chosen from the group consisting of polyethylene glycol, sorbitol, maltodextrin, and sugars.

22. The method of claim 17, wherein the binder is polyethylene glycol 8000.

23. The method of claim 17, wherein the fiber carrier is cellulose.

24. The method of claim 17, wherein the lubricant comprises from about 0.5% to about 8% by weight of the starting materials.

25. The method of claim 17, wherein the lubricant is chosen from the group consisting of: sodium benzoate, stearates, mineral oil, silicates and algenic acid.

26. The method of claim 25, wherein the stearate comprises magnesium stearate.

27. The method of claim 17, wherein the lubricant comprises a mixture of sodium benzoate and magnesium stearate.

28. The method of claim 27, wherein the sodium benzoate comprises from approximately 1% to approximately 5% by weight of the starting materials.

29. The method of claim 27, wherein the magnesium stearate comprises from approximately 0.5% to approximately 3% by weight of the starting materials.

30. The method of claim 17, wherein the fragrance comprises from approximately 0.5% to approximately 1.5% by weight of the starting materials.

31. The method of claim 1, wherein the trickle of tap water is from about 0.5 liter to about 1.5 liters per minute.

* * * * *